US006686521B2

(12) United States Patent
Sandifer

(10) Patent No.: US 6,686,521 B2
(45) Date of Patent: Feb. 3, 2004

(54) KEYBOARD INSTRUMENT

(75) Inventor: Paul Sandifer, Beds (GB)

(73) Assignees: Yamaha Corporation (JP); Kemble & Co. (GB)

( * ) Notice: Subject to any disclaimer, the term of this patent is extended or adjusted under 35 U.S.C. 154(b) by 0 days.

(21) Appl. No.: 09/823,518

(22) Filed: Mar. 30, 2001

(65) Prior Publication Data

US 2002/0139236 A1 Oct. 3, 2002

(51) Int. Cl.[7] ..... G10C 3/02
(52) U.S. Cl. ..... 84/179
(58) Field of Search ..... 84/179, 177, 178, 84/176

(56) References Cited

U.S. PATENT DOCUMENTS

| | | | | |
|---|---|---|---|---|
| 4,939,969 A | * | 7/1990 | Taguchi et al. | 84/719 |
| 5,056,396 A | | 10/1991 | Furukawa | |
| 5,918,296 A | * | 6/1999 | Ishida et al. | 84/177 |
| 5,942,702 A | * | 8/1999 | Inoue | 84/179 |
| 6,130,371 A | * | 10/2000 | Inoue | 84/179 |
| 6,353,163 B2 | * | 3/2002 | Suzuki | 84/179 |

FOREIGN PATENT DOCUMENTS

| | | |
|---|---|---|
| DE | 46 401 | 4/1889 |
| DE | 126 079 | 12/1901 |
| DE | 140 895 | 5/1903 |
| EP | 0697 541 A1 | 2/1996 |
| EP | 0901 117 A2 | 3/1999 |
| GB | 2 356 484 A | 5/2001 |

* cited by examiner

*Primary Examiner*—Kimberly Lockett
(74) *Attorney, Agent, or Firm*—Morrison & Foerster LLP

(57) ABSTRACT

A keyboard instrument such as an upright piano is basically constructed by a keyboard, an action, a case assembly, a fall assembly, a back hollow assembly and a top door assembly. Herein, the fall assembly provides a fall cover for covering the keyboard, and the top door assembly having an opening top door is linked to the fall assembly by way of the back hollow assembly. The top door pivotally moves in response to movement of the fall cover of the fall assembly being closed or opened, wherein when the fall cover is opened, the top door opens to produce a small gap in proximity to a lower end of the top door. The small gap allows piano sound to be partially released from a casing to increase loudness of the piano sound and to enhance clarity in tone color of the piano sound. The keyboard instrument further provides a damping mechanism for imparting resistance load to the fall cover being closed or opened. That is, the damping mechanism uses a rotation damper containing viscous fluid that moves in response to pivotal movement of the fall cover to produce torque by which an increasing load is to be automatically imparted to the fall cover being closed.

14 Claims, 7 Drawing Sheets

KEYBOARD INSTRUMENT

BACKGROUND OF THE INVENTION

1. Field of the Invention

This invention relates to keyboard instruments such as upright pianos having loudness increase structures.

2. Description of the Related Art

In general, upright pianos are constructed to realize opening functions of top covers which are hinged to top places of cases, so users or players are capable of opening the top covers to increase tone volumes of piano sounds. However, because general users tend to place some articles or objects on the top covers, the upright pianos cannot always demonstrate the opening functions for increasing tone volumes of piano sounds.

SUMMARY OF THE INVENTION

It is an object of the invention to provide a keyboard instrument such as an upright piano that is capable of realizing an opening function for increasing tone volume of piano sound without being interrupted by an article or object being placed on a top cover.

A keyboard instrument such as an upright piano is basically constructed by a keyboard, an action, a case assembly, a fall assembly, a back hollow assembly and a top door assembly. Herein, the fall assembly provides a fall cover for covering the keyboard, and the top door assembly having an opening top door is linked to the fall assembly by way of the back hollow assembly. The top door pivotally moves in response to movement of the fall cover of the fall assembly being closed or opened, wherein when the fall cover is opened, the top door opens to produce a small gap (52) in proximity to a lower end of the top door. The small gap allows piano sound to be partially released from a casing to increase loudness of the piano sound and to enhance clarity in tone color of the piano sound. Because the keyboard instrument arranges the top door not to be interrupted by an article or object being placed on a top board by a user or player, it is possible to secure the opening function of the top door being opened in connection with opening of the fall cover, so the keyboard instrument is capable of normally demonstrating a loudness enhancement effect of sound.

In addition, the keyboard instrument further provides a damping mechanism for imparting resistance load to the fall cover being closed or opened. That is, the damping mechanism uses a rotation damper containing viscous fluid that moves in response to pivotal movement of the fall cover to produce torque by which an increasing load is to be automatically imparted to the fall cover being closed. Thus, it is possible to avoid occurrence of accident due to slammed shut of the fall cover of the piano.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

Figure 1:
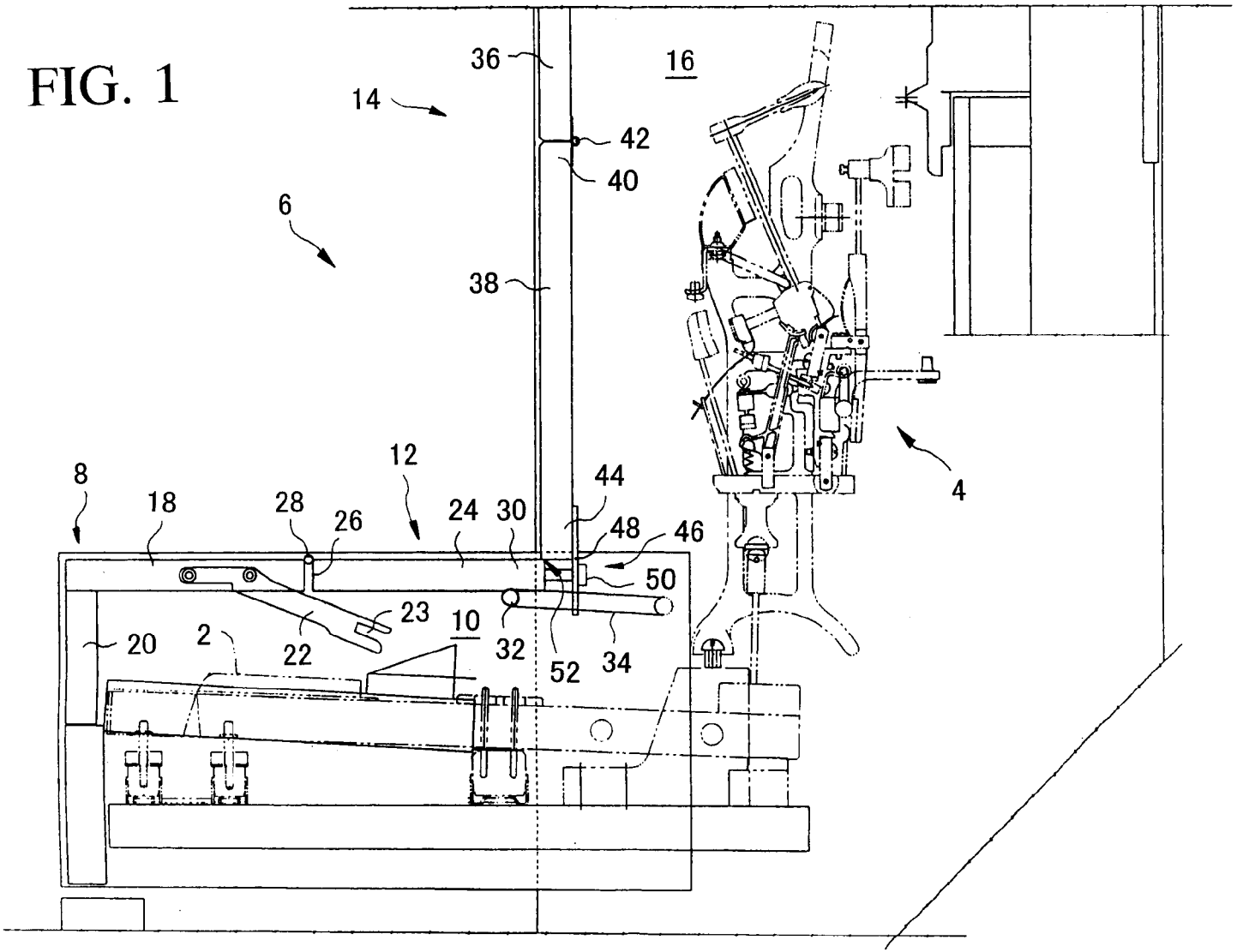
FIG. 1 is a sectional view showing selected parts in construction of an upright piano in which a fall assembly is placed in a closed position.
Figure 2:
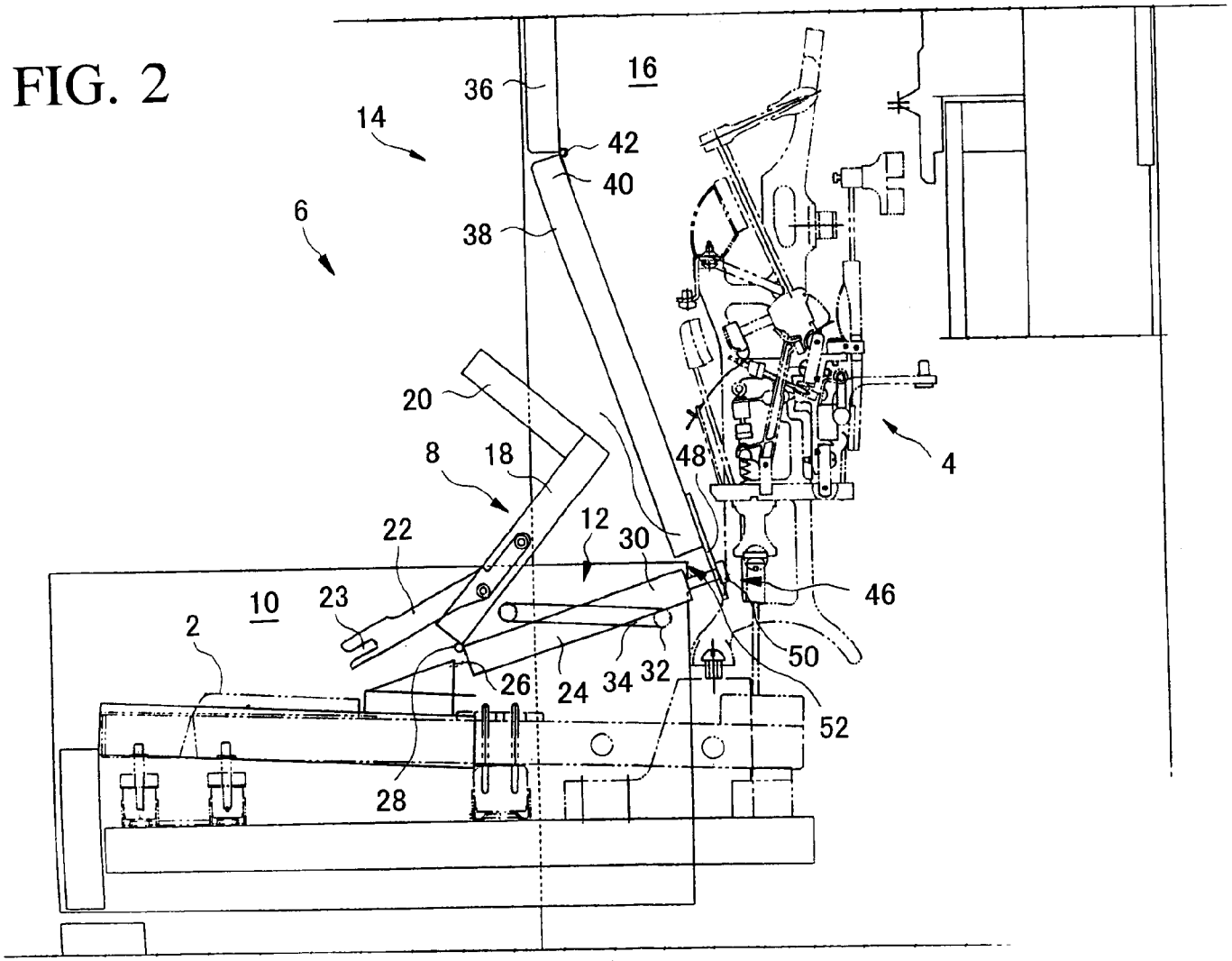
FIG. 2 is a sectional view showing selected parts in construction of the upright piano in which the fall assembly is placed in an open position.

FIGS. 1 and 2 show an upper portion in cross section of an upright piano in accordance with the preferred embodiment of the invention. The upper portion of the upright piano has a keyboard 2, an action 4 and a case assembly 6, wherein FIGS. 1 and 2 merely show only selected parts of an upper portion of the case assembly 6. A lower portion of the case assembly 6 provides strings and tuning keys, which are conventional parts of the upright piano and are omitted in illustration. Similarly, the keyboard 2 and action 4 are conventional parts of the upright piano, hence, detailed description thereof will be omitted.

The case assembly 6 includes a fall assembly 8 hinged to side arms 10, which are placed at side ends of the keyboard 2, a back hollow assembly 12 connected to the fall assembly 8 and a top door assembly 14 whose side ends are connected to side portion 16 of the case assembly 6. The top door assembly 14 acts as a front panel being closed for hiding the action 4 inside the case assembly 6.

The case assembly 6 also includes a bottom door assembly, a top cover, a base and a rear panel, all of which are conventional parts of the upright piano and are not shown in the drawings.

The fall assembly 8 provides an opening cover for covering the keyboard 2, which includes a cover top 18 and a cover front 20. The cover top 18 is attached to a pivot mechanism 23 by means of two slender metal arms (namely, pivot arms) 22. The pivot mechanism 23 is fixed to the side arms 10 which are placed at the side ends of the keyboard 2. It is possible to provide a damping mechanism to prevent the fall cover from being slammed shut by a user or player. The damping mechanism can be constructed as similar to one disclosed by European patent application publication EP 0697541 A1. In addition, it is possible to employ a fall mechanism as similar to one disclosed by European patent application publication EP 0901117 A2. Incidentally, details of the aforementioned publications will be described later.

FIG. 1 shows a closed position of the fall assembly 8, while FIG. 2 shows an open position of the fall assembly 8. To realize an interval of distance or angle between the closed position and open position of the fall assembly 8, the pivot arms 22 are subjected to limited rotation about the pivot mechanism 23, that is, rotation of approximately 130°.

The back hollow assembly 12 includes a cover rear (or a panel) 24 that extends entirely across a width of the keyboard 2. A front end of the cover rear 24 is connected to a back end of cover top 18 by a strap hinge 28. Two pins 32 are arranged in proximity to a back end 30 of the cover rear 24 and in contact with an underside of the cover rear 24. Concretely speaking, the two pins 32 are respectively arranged on side ends of the cover rear 24 and are placed to engage with guide slots 34, which are elongated along inner surfaces of the side arms 10 in a slanted manner.

In the closed position of the fall assembly 8 shown in FIG. 1, the cover rear 24 is supported horizontally and maintained approximately at a same height of the cover top 18 because the front end 26 is supported by the strap hinge 28 while the back end 30 is supported by the pins 32. From the closed position, the user or player gradually opens the fall cover so that the fall assembly 8 is to be placed in the open position as shown in FIG. 2. Accompanied with movement of the fall cover being opened, the pins 32, which are originally placed in proximity to the back end 30 of the cover rear 24, slide and move rearwards inside of the slanted guide slots 34. In addition, the front end 26 of the cover rear 24 moves together with the back end of the cover top 18 and rotates about a pivot mechanism 23 along a prescribed arc orbit. In the open position of the fall assembly 8 shown in FIG. 2, the front end 26 of the cover rear 24 is lowered in elevation and moved rearwards as compared with an original position thereof. Thus, the cover rear 24 is slightly inclined in a forward direction.

The top door assembly 14 includes an upper top door 36 and a lower top door 38. Normally, the upper top door 36 is fixed in position to the side portions 16 of the case assembly 6 to cope with use of the upright piano. An upper end 40 of the lower top door 38 is connected to a lower end of the upper top door 36 by a strap hinge 42. The lower top door 38 can be rotated rearwards about the strap hinge 42, so that it is to be entered into an inside of the case assembly 6 of the upright piano. To enable tuning of the upright piano, for example, it is possible to remove the upper top door 36 by the conventional method.

A lower end 44 of the lower top door 38 is connected to the back end 30 of the cover rear 24 by means of multiple link members 46. The link members 46 are arranged at side ends of the lower end 44 of the lower top door 38. It is possible to provide additional link members along an intermediate portion of a tapped board 48. Each of the link members 46 is very simple in construction and is made by a single tapped board 48, for example. The tapped board 48 is arranged such that it extends downwards from the lower end 44 of the lower top door 38. Bolts 50 each constructed by a shaft and a head are placed to engage with tapped holes of the tapped board 48. Herein, the bolts 50 extend rearwards from the back end 30 of the cover rear 24. The shafts of the bolts 50 are inserted into the tapped holes of the tapped board 48. Due to engagement of the bolts 50 and tapped board 48 in the closed position of the fall assembly 8 shown in FIG. 8, it is possible to securely stop the lower top door 38 in a closed position (namely, vertically closed position). When the lower top door 38 is stopped in the closed position, the cover rear 24 is tightly fixed in position together with the lower top door 38 such that substantially no gap would be formed between the back end 30 of the cover rear 24 and the lower end 44 of the lower top door 38.

In the open position of the fall assembly 8 shown in FIG. 2, as the back end 30 of the cover rear 24 moves rearwards, it presses the lower end 44 of the lower top door 38 by means of the tapped board 48 and bolts 50 so that the lower top door 38 is vertically inclined from its vertical stop position. Due to the aforementioned movement, a small gap 52 is to be formed between the back end 30 of the cover rear 24 and the lower end 44 of the lower top door 38. Such a small gap 52 allows sound waves of piano sound to be released outside of the casing of the upright piano. This brings an increase of tone volume of the piano sound. Accompanied with movement of the fall cover being opened, the bolts 50 are not disengaged from the tapped holes of the tapped board 48, hence, they merely move inside of the casing of the upright piano.

To play the upright piano, the user opens or closes the fall cover of the fall assembly 8 so that the lower top door 38 is correspondingly opened or closed. In the open position of the fall assembly 8, the small gap 52 appears between the back end 30 of the cover rear 24 and the lower end 44 of the lower top door 38. In the closed position of the fall assembly 8, the gap 52 disappears.

Next, a description will be given with respect to an example of the damping mechanism as disclosed by the aforementioned European patent application publication EP 0697541 A1.

Figure 3:
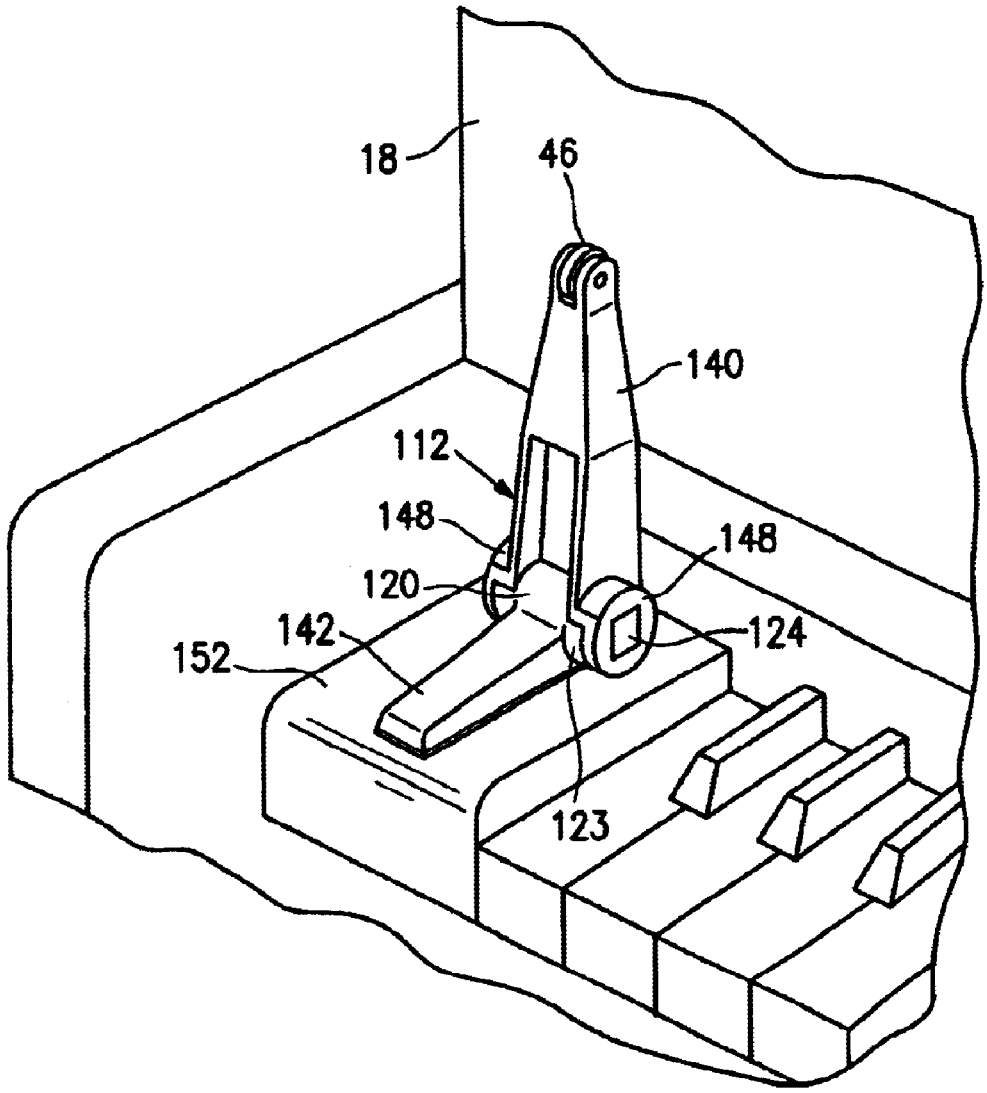
FIG. 3 is a perspective view showing appearance of a damping mechanism that is applicable to the upright piano.

FIG. 3 shows selected parts in construction of a damping mechanism 112, which contains a rotation damper 120, an arm 140 and a support base 142. The arm 140 is capable of pivotally moving about the rotation damper 120, which is integrally formed together with the support base 142. A bottom of the support base 142 is fixed to a wooden part 152 of the piano by appropriate fixing means such as a both-side adhesive tape and a wood screw. A roller 146 is attached to a tip end of the arm 140, about which it is capable of freely rotating. The roller 146 is normally pressed in contact with an interior surface of the cover top 18 of the fall cover of the piano. A lower end of the arm 140 is forked to a pair of arm support portions 148, which are pivotally supported by the rotation damper 120. The rotation damper 120 has a shaft 124 having square terminal ends, which engage with the arm support portions 148 respectively. Accompanied with pivotal movement of the arm 140, the square shaft 124 of the rotation damper 120 rotates about an axis thereof.

FIG. 3 excludes detailed illustration in which a plate spring is hooked on a back of the arm 140 from the bottom of the support base 142. The plate spring (not shown) has elasticity by which the arm 140 is normally forced to move in an opening direction. Due to restoration force of the plate spring, when the user or player starts to open the fall cover of the fall assembly 8, the arm 140 presses the cover top 18 upwardly to assist the fall cover being opened. When the user of player closes the fall cover of the fall assembly 8, the plate spring applies a load to the arm 140 to resist against closing of the fall cover, so that the fall cover is to be slowly and softly closed.

Figure 4:
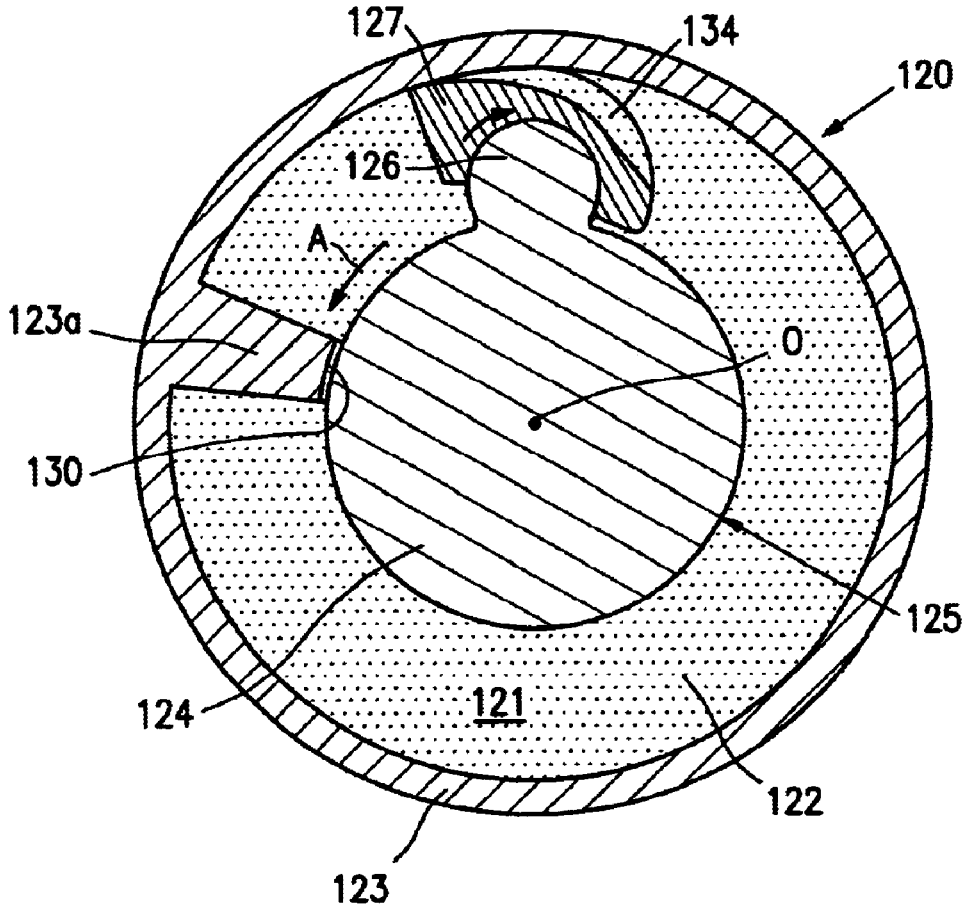
FIG. 4 is a sectional view showing internal construction of a rotation damper of the damping mechanism in connection with the fall assembly being closed.

FIG. 4 shows details of construction of the rotation damper 120 having the shaft 124 which is contained a cylindrical casing 123. A center 'O' of a cross section of the shaft 124 matches with a center of a cylinder of the casing 123. The casing 123 has an inner space which is filled with viscous fluid 122 having high viscosity such as grease. A casing blade 123*a* is formed together with the casing 123. The casing blade 123*a* projects inwardly with the casing 123 and also extends lengthwise along a longitudinal direction of the casing 123. The casing blade 123*a* functions as a stopper for regulating rotation of a rotation member 125 having the shaft 124.

The shaft 124 has a support projection 126 that supports a moving valve 127 to freely rotate. The support projection 126 extends lengthwise along a longitudinal direction of the shaft 124. Roughly speaking, the support projection 126 has a circular sectional shape. FIG. 4 merely shows a single support projection 126 that is formed integrally together with shaft 124. However, it is possible to form multiple support projections with respect to the shaft 124.

Figure 5:
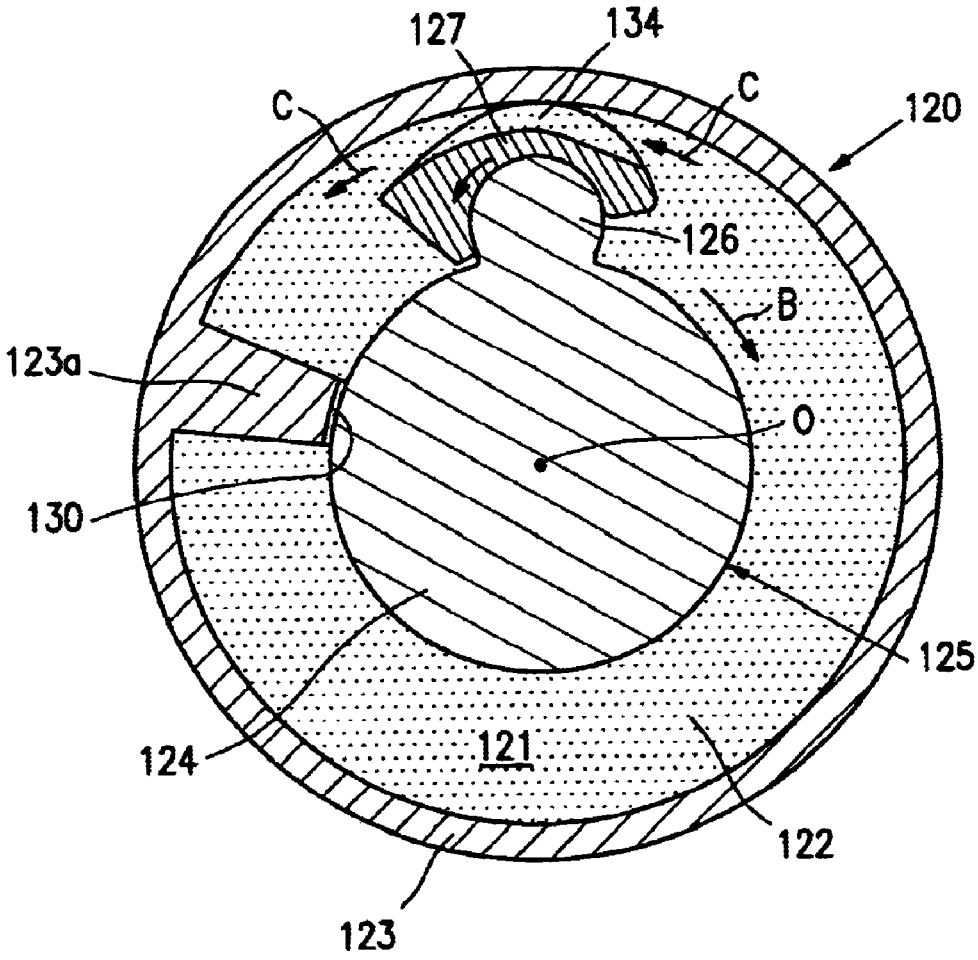
FIG. 5 is a sectional view showing internal construction of the rotation damper of the damping mechanism in connection with the fall assembly being opened.

The moving valve 127 is accompanied with a fluid passage 134 in which the viscous fluid 122 can move in response to rotation of the rotation member 125, which is shown in FIG. 5. FIG. 4 shows that the moving valve 127 is placed in tight contact with an interior wall of the casing 123, so the fluid passage 134 does not perform its functions. Accompanied with movement of the fall cover of the fall assembly 8 to be opened or closed, the rotation member 125 rotates about the axis thereof, so that the moving valve 127 slides and moves about the support projection 126 along a prescribed arc orbit against resistance being produced by the viscous fluid 122.

When the user or player closes the fall cover of the fall assembly 8, the shaft 124 rotates in a counterclockwise direction A inside of the casing 123 as shown in FIG. 4. In that case, the viscous fluid 122 apply resistance to the moving valve 127. Due to such resistance, the moving valve 127 moves and rotates in a clockwise direction to be placed in tight contact with the interior wall of the casing 123. Herein, the viscous fluid 122 could flow by passing through a narrow gap 130 between an tip end of the casing blade 123*a* and an exterior wall of the shaft 124. Flowing speed of the viscous fluid 122 is low so that high rotation torque is to be produced. In short, a damping effect is applied to the fall assembly 8 when the user or player closes the fall cover.

In contrast, if the rotation member 125 rotates in a clockwise direction B inside of the casing 123 as shown in FIG. 5, the moving valve 127 moves and rotates about the support projection 126 in a counterclockwise direction against resistance being produced by the viscous fluid 122. In that case, the moving valve 127 leaves from the interior wall of the casing 123 so that the fluid passage 123 is spaced apart from the interior wall of the casing 123 with a gap. Such a gap allows the viscous fluid 122 to smoothly flow inside of the casing 123. In short, a damping effect applied to the fall assembly 8 is weakened when the user or player opens the fall cover.

In the aforementioned damping mechanism, the moving valve 127 slides on the support projection 126 having a circular sectional shape along the prescribed arc orbit. The sectional shape of the support projection is not necessarily made circular, hence, it is possible to design the support projection having a rectangular sectional shape. That is, it is possible to modify the damping mechanism such that the moving valve 126 slides on the rotation member 125 in its radius direction in response to movement of the fluid inside of the casing 123.

Figure 6:
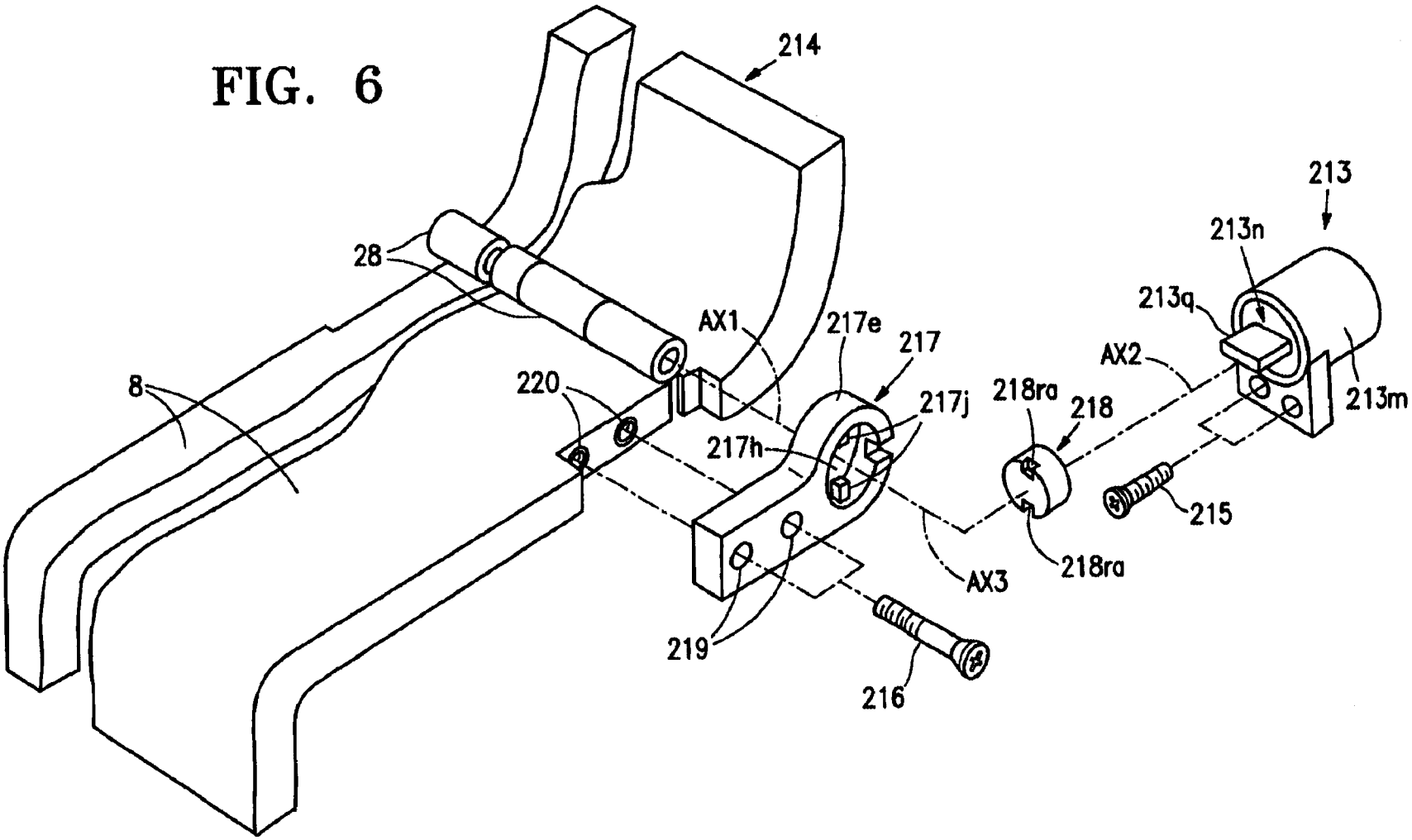
FIG. 6 is a fragmentarily exploded perspective view showing selected parts for realizing an example of a damping mechanism for the fall assembly.

Next, a description will be given with respect to an example of the fall mechanism as disclosed by the foregoing European patent application publication EP 0901117 A2. FIG. 6 shows parts constructing a back end portion of the fall assembly 8, wherein a fall cover is pivotally connected to a cover rear 214 by means of a strap hinge 28. In proximity to the strap hinge 28, a rotation damper 213 is arranged to prevent the fall cover of the fall assembly 8 from being roughly closed. A damper case 213*m* of the rotation damper 213 is buried in an interior wall of a side arm 4 of the piano and is fixed by means of screws 215.

Figure 7A:
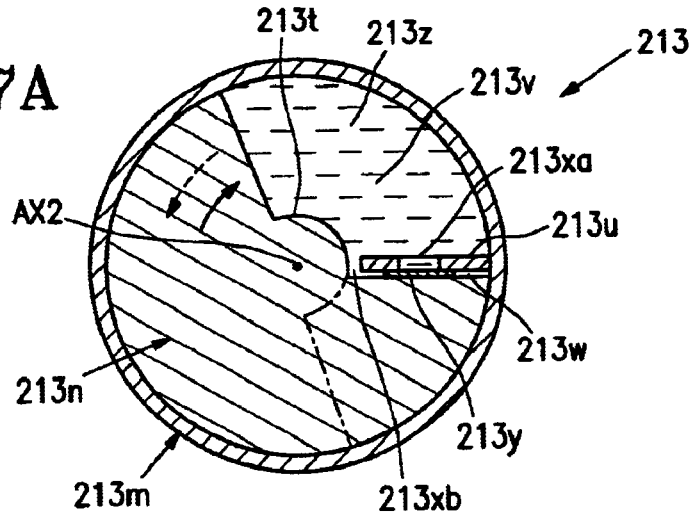
FIG. 7A is a cross sectional view showing an internal construction of a rotation damper, which is an essential part of the damping mechanism shown in FIG. 6, when the fall assembly is placed in a closing position.
Figure 7B:
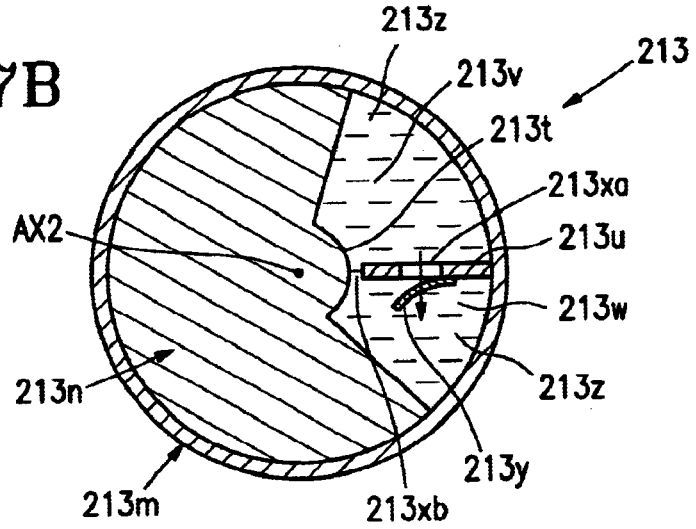
FIG. 7B is a cross sectional view showing an internal construction of the rotation damper when the fall assembly is placed in an intermediate position.
Figure 7C:
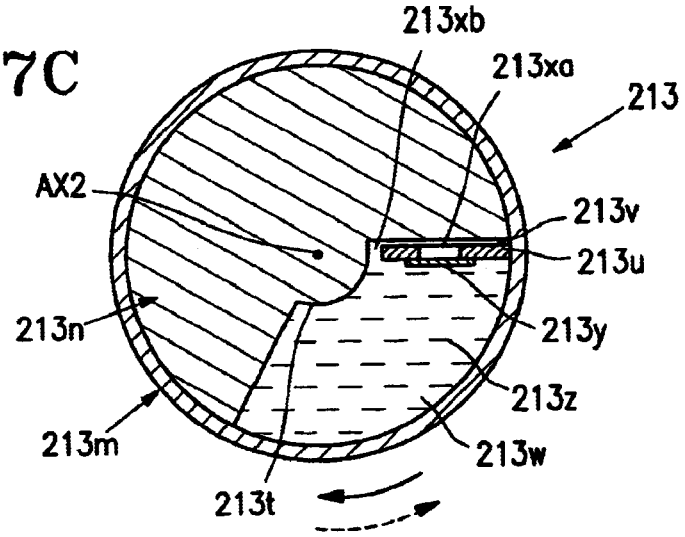
FIG. 7C is a cross sectional view showing an internal construction of the rotation damper when the fall assembly is placed in an open position.

The rotation damper 213 works using viscous resistance of fluid therein. That is, the rotation damper 213 contains a rotation shaft 213*n* that can rotate freely inside of the damper case 213*m* having a cylindrical shape, which is shown in FIGS. 7A to 7C. A sectional shape of the rotation shaft 213*n* does not correspond to an entire circle but is partially cut by a sector, in which non-compressive damping oil 213*z* is enclosed. Such a sector space inside of the damper case 213 is partitioned into two chambers, namely damping chambers 213*v*, 213*w* by a partition wall 213*u* that projects inwardly from an interior wall of the damper case 213*m*.

The first damping chamber 213*v* and second damping chamber 213*w* communicate with each other by way of a communication hole 213*xa* that is formed at a selected position of the partition wall 213*u*. The partition wall 213*u* provides a check valve 213*y* by which the communication hole 213*xa* can be closed. In addition, the rotation shaft 213*n* has a projection 213*t* having an arc shape in section. When the rotation shaft 213*n* rotates about a center axis AX2 in a clockwise direction inside of the damper case 213*m*, the check valve 213*y* opens the communication hole 213*xa* as shown in FIGS. 7A–7C. This allows the damping oil 213*z* to smoothly flow between the damping chambers 213*v* and 213*w* by way of the communication hole 213*xa*. In contrast, when the rotation shaft 213*n* rotates in a counterclockwise direction, the check value 213*y* closes the communication hole 213*xa* in response to flow of the damping oil 213*z*, which is caused by counterclockwise rotation of the rotation shaft 213*n*. In this case, the damping oil 213*z* is capable of flowing between the damping chambers 213*v* and 213*w* by way of a gap 213*xb* that is formed between an arc-shaped exterior surface of the projection 213*t* and a tip end of the partition wall 213*u*. Due to small flowing speed of the damping oil 213*z* by way of the gap 213*xb*, a relatively high rotation torque is caused to occur in the rotation damper 213. Based on such a working principle of the rotation damper 213, a damping effect is applied to the fall cover of the fall assembly 8 being closed. Such a damping effect is weakened when the user or player opens the fall cover of the piano.

The aforementioned technique provides a so-called deviation absorption structure by which positional deviation between a rotation center of the strap hinge 28 and a rotation center of the rotation damper 213 is absorbed to suppress noise or to avoid occurrence of abrasion or damage in FIG. 6. Concretely speaking, such a deviation absorption structure is embodied by a deviation absorption member 218 that engages with a connection member 217 fixed to a side wall of the back end portion of the fall assembly 8. Herein, the rotation shaft 213*n* of the rotation damper 213 engages with the deviation absorption member 218.

A pair of through holes 219 are formed to penetrate through the connection member 217 in thickness and are placed to match with a pair of tapped holes 220 formed on the side wall of the fall cover respectively. By engaging screws 216 into the tapped holes 220 by way of the through holes 219, it is possible to securely fix the connection member 217 onto the side wall of the fall assembly 8. The connection member 217 has a cylindrical portion 217*e* having an inner space 217*h*, into which the deviation absorption member 218 is inserted to engage with. Two projections 217*j* project from an circumferential interior wall of the inner space 217*h* and are arranged linearly in opposite directions. A center axis of the cylindrical portion 217*e* approximately matches with the rotation center AX1 of the strap hinge 28 of the fall assembly 8.

The deviation absorption member 218 is formed in a cylindrical shape whose outer diameter is smaller than an inner diameter of the cylindrical portion 217*e* of the connection member 217. One terminal end of the deviation absorption member 218 is partially cut to form a pair of recesses 218*ra*, which are formed at circumferentially opposite positions. When the deviation absorption member 218 engages with the inner space 217*h* of the cylindrical portion 217*e*, the recesses 218*ra* match with the projections 217*j* respectively. As compared with the projections 217*j*, the recesses 218*ra* are slightly elongated to allow a small linear sliding movement of the deviation absorption member 218 along the projections 217*j* in the inner space 217*h*.

A channel (not shown) is formed on another terminal end of the deviation absorption member 218 to extend in a direction perpendicular to a direction of linear arrangement of the recesses 218*ra*. A projecting member 213*q* is formed integrally with the rotation shaft 213*n* of the rotation damper 213 and is linearly elongated to match with a diameter of the rotation shaft 213*n*. When the rotation damper 213 is assembled together with the deviation absorption member 218, the projecting member 213*q* engages with the aforementioned channel within which it can freely slide and move. That is, relative movement is realized between the rotation shaft 213*n* of the rotation damper 213 and the deviation absorption member 218 in the direction along which the channel extends. As described above, an assembly of the connection member 217, deviation absorption member 218 and rotation shaft 213*n* function as an Oldham's coupling.

In response to pivotal movement of the fall cover of the fall assembly 8 being opened or closed, the connection member 217 pivotally moves together with the fall assembly 8. This occasionally causes the deviation absorption member 218 to move within the inner space 217*h* of the cylindrical portion 217*e*, so that rotation torque is transmitted to the rotation shaft 213*n* of the rotation damper 213. Therefore, the rotation shaft 213*n* rotates inside of the damper case 213*m* that is fixed to the side arm of the piano. Thus, it is possible to obtain a damping effect, which is described before with reference to FIGS. 7A–7C. Due to operation of the Oldham's coupling, even if positional deviation emerges between the rotation center AX1 of the strap hinge 28 of the fall assembly 8 and the rotation center AX2 of the rotation damper 213*n*, the aforementioned parts smoothly operate to secure the damping effect. As a result, it is possible to suppress noise or avoid occurrence of abrasion or damage.

It may be needless to say that various types of modifications can be proposed for the upright piano of the present invention within the scope of the invention. That is, the damping mechanism is not necessarily limited in position as described in the present embodiment. For example, it is possible to arrange the damping mechanism for prevention of slammed opening of the fall cover in contact with an underside of the cover rear 24. In addition, it is possible to employ various structures for the link members 46. The present embodiment describes the top door assembly being constructed by a fixed upper top door and an opening lower top door. Instead of such construction, it is possible to construct the top door assembly by a single top door that can be opened in connection with opening of the fall cover of the piano.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A keyboard instrument comprising:

a keyboard; and a case assembly, within which the keyboard is carried, said case assembly including a fall assembly for covering the keyboard and a front panel linked to the fall assembly for covering a front portion of the keyboard instrument, said front panel having a door section that can be opened.

2. A keyboard instrument comprising:

a keyboard; and a case assembly within which the keyboard is carried, said case assembly including:

a fall assembly having a fall cover for covering the keyboard; and a front panel having a door section for covering a front portion of the keyboard instrument, wherein the front panel is linked to the fall assembly so that the door section is automatically opened in response to a movement of the fall cover being opened.

3. A keyboard instrument comprising:

a keyboard; and a case assembly within which the keyboard is carried, said case assembly including:

a fall assembly having a fall cover for covering the keyboard; and a front panel having a door section for covering a front portion of the keyboard instrument, wherein the front panel is linked to the fall assembly so that the door section is in a closed position in response to the fall cover being closed.

4. A keyboard instrument according to any one of claims 1 to 3 wherein the front panel is linked to the fall assembly by way of a back hollow assembly.

5. A keyboard instrument according to any one of claims 1 to 3 wherein the front panel is linked to the fall assembly by way of a back hollow assembly having a cover rear that moves in a slide manner and is linked to the fall assembly by means of a pivot mechanism.

6. A keyboard instrument according to any one of claims 1 to 3 wherein the front panel is linked to the fall assembly by way of a back hollow assembly having a cover rear that moves in a slide manner and that is linked to the fall assembly by means of a pivot mechanism and is also linked to the front panel by means of link members.

7. A keyboard instrument according to any one of claims 1 to 3 wherein the door section of the front panel pivotally moves about a rotation axis that is maintained horizontally and is arranged at a prescribed upper position of the case assembly.

8. A keyboard instrument according to any one of claims 1 to 3 wherein the door section of the front panel pivotally moves about a rotation shaft, which is maintained horizontally and is arranged at a prescribed upper position of the case assembly within a prescribed range of distance being defined between a closed position and an open position, wherein the door section is vertically displaced in the closed position and inclined rearwards in the open position.

9. A keyboard instrument according to any one of claims 1 to 3 wherein the door section of the front panel pivotally moves about a rotation shaft, which is maintained horizontally and is arranged at a prescribed upper position of the case assembly within a prescribed range of distance being defined between a closed position and an open position, wherein a small gap is produced in proximity to a lower end of the door section when the door section is inclined rearwards in the open position, and wherein the small gap is closed when the door section is in the closed position.

10. A keyboard instrument according to any one of claims 1 to 3 wherein the front panel includes a fixed upper section linked to the door section, wherein the door section pivotally moves about a rotation axis that is maintained horizontally and is arranged at a prescribed upper position of the case assembly.

11. A keyboard instrument according to any one of claims 1 to 3 wherein the front panel includes a fixed upper section linked to the door section, wherein the door section pivotally moves about a strap hinge arranged between the fixed upper section and the door section.

12. A keyboard instrument according to any one of claims 1 to 3 further comprising a damping mechanism for applying a damping effect on movement of the fall cover of the fall assembly being closed or opened.

13. An upright piano comprising:

a keyboard;

a case assembly within which the keyboard is carried, said case assembly including a fall assembly having a fall cover for covering the keyboard and a front panel having a door section, wherein the front panel is linked to the fall assembly by way of a back hollow assembly so that the door section pivotally moves in response to movement of the fall cover of the fall assembly being closed or opened, wherein when the fall cover is opened, the door section opens to produce a small gap; and a damping mechanism for imparting resistance load to the fall cover being closed or opened.

14. An upright piano according to claim 13 wherein the damping mechanism has a rotation damper containing viscous fluid that moves in response to pivotal movement of the fall cover to produce torque by which an increasing load is to be automatically imparted to the fall cover being closed.

* * * * *